United States Patent [19]

Berriochoa et al.

[11] Patent Number: 4,941,600

[45] Date of Patent: Jul. 17, 1990

[54] DISPENSER LOCK ASSEMBLY FOR A PRESSURIZED CONTAINER

[75] Inventors: Gary H. Berriochoa, Roanone; Howard Dudley, Grapevine, both of Tex.

[73] Assignee: Technical Chemical Company, Dallas, Tex.

[21] Appl. No.: 401,644

[22] Filed: Aug. 31, 1989

[51] Int. Cl.[5] ..... B65D 83/24

[52] U.S. Cl. ..... 222/402.13; 222/402.14

[58] Field of Search ..... 222/153, 182, 402.1, 222/402.13, 402.14, 527–529

[56] References Cited

U.S. PATENT DOCUMENTS

| | | | |
|---|---|---|---|
| 3,178,077 | 4/1965 | Benedetto | 222/394 |
| 3,273,610 | 9/1966 | Frost | 222/402.14 X |
| 3,395,838 | 8/1968 | Beres et al. | 222/402.14 |
| 3,478,938 | 11/1969 | Krause | 222/402.14 |
| 3,804,302 | 4/1974 | Yamada et al. | 222/182 |
| 3,901,412 | 8/1975 | Copia | 222/182 |
| 4,186,853 | 2/1980 | White | 222/182 |
| 4,278,188 | 7/1981 | Stephenson et al. | 222/182 |
| 4,381,065 | 4/1983 | Hayes | 222/153 |
| 4,428,509 | 1/1984 | Emerson et al. | 222/153 |
| 4,440,325 | 4/1984 | Treuhaft et al. | 222/402.14 |

*Primary Examiner*—Michael S. Huppert

*Attorney, Agent, or Firm*—Charles D. Gunter, Jr.

[57] ABSTRACT

A lock assembly is shown for locking the valve stem of an aerosol container in the open position. The lock assembly includes a cap with an interior recess and an actuator tab connected to the cap and extending across the valve stem within the interior recess. A ring lock is located within the cap interior below the actuator tab and has a hook portion for engaging the tab when the tab is depressed to move the valve to the open position.

11 Claims, 1 Drawing Sheet

DISPENSER LOCK ASSEMBLY FOR A PRESSURIZED CONTAINER

BACKGROUND OF THE INVENTION

1. Field of the Invention

The present invention relates to dispensing devices for pressurized containers and specifically to a dispenser lock for automatically dispensing the contents of an aerosol can.

2. Description of the Prior Art

Portable pressurized containers, such as pressurized aerosol cans, are employed in a myriad of diverse applications at the present time. Most of the commercially available aerosol containers are provided with a depressible nozzle or valve stem at the upper end thereof. The valve stem is typically spring-biased and in normal operation the nozzle is depressed by applying pressure with the user's finger. The depression of the valve stem opens a release valve to allow the pressurized contents of the container to be directed out a discharge orifice. The person operating the pressurized container must maintain his finger in pressure contact with the valve stem during use, since the valve is normally biased so that it will remain closed except during the time that the valve stem is held in the depressed position. As a result, use of such pressurized containers for prolonged periods of time can be tedious and time consuming. Also, it is often desirable to maintain the valve stem in an open position until the entire contents of the container are exhausted. In other cases, it may be dangerous to remain in the close vicinity to the open container and its out flowing contents for a relatively long period of time.

The present invention has as its object a dispenser lock assembly for continuously dispensing the contents of an aerosol container without the necessity of continuous finger pressure on the valve stem.

Another object of the invention is to provide such a dispenser lock assembly which is simple in design and economical to manufacture.

A particular application of the dispenser lock assembly is a pressurized container holding a tire sealer and inflator for an automobile tire. The time required to dispense the contents of such a pressurized container is approximately one and one half minutes. The dispenser lock assembly eliminates user fatigue and allows the user to move from the immediate vicinity of the tire being inflated.

Additional objects, features and advantages will be apparent in the written description which follows.

SUMMARY OF THE INVENTION

The lock assembly of the invention is used for continuously dispensing the pressurized contents of an aerosol container of the type having an upstanding valve stem protruding from end of the container. The lock assembly includes a cap which has a generally cylindrical skirt portion adapted for attachment to the container in a position surrounding the stem. The skirt portion extends upwardly to define an interior recess. An actuator tab is hingedly connected to the cap within the interior recess and extends across the stem when the skirt is attached to the container. The actuator tab includes a stem-engaging internal bore and a fluid passageway for connecting the stem so engaged to a discharge orifice. A ring lock is located within the cap interior recess below the actuator tab. The ring lock has a ring-shaped body with a central opening for receiving the valve stem and has a hook portion which extends upwardly from the ring-shaped body generally parallel to the valve stem for engaging the actuator tab when the actuator tab is depressed within the interior recess of the cap.

BRIEF DESCRIPTION OF THE DRAWINGS

FIG. 1 is a top, perspective view of a portion of an aerosol can showing the lock assembly of the invention in exploded fashion;

FIG. 2 is an isolated view of the lock assembly of FIG. 1 showing the ring lock exploded outwardly from the lock cap;

DETAILED DESCRIPTION OF THE INVENTION

Figure 3:
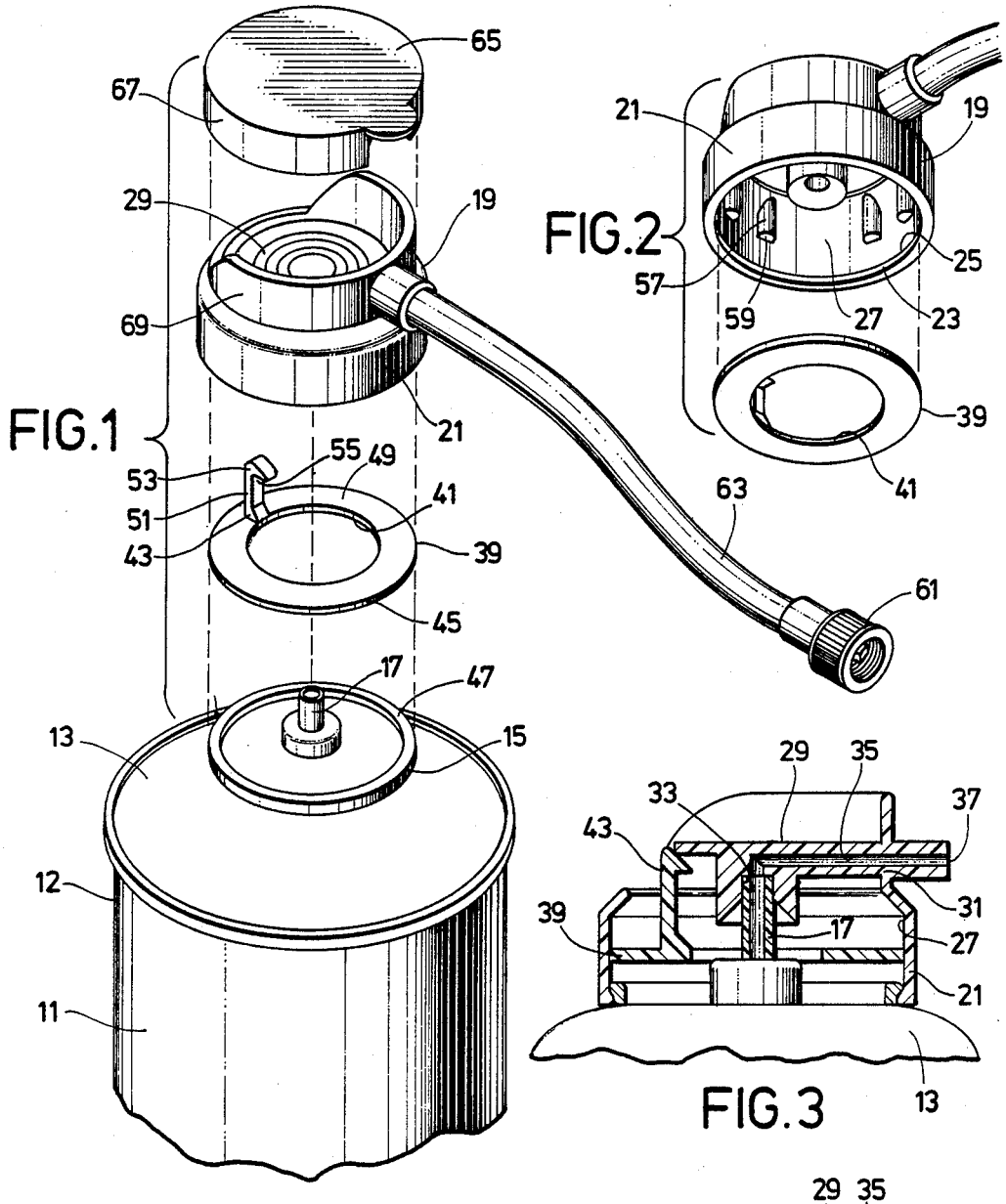
FIG. 3 is a side, cross-sectional view of the lock assembly of FIG. 1 in place on the aerosol can with the valve stem in the normally closed position.
Figure 4:
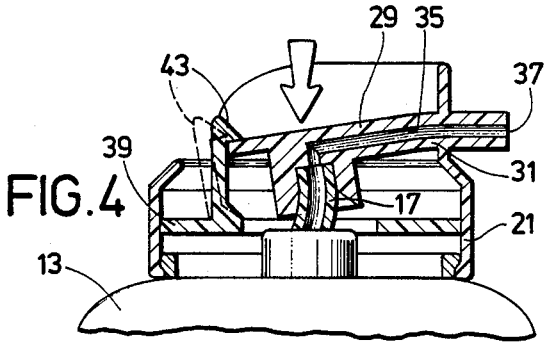
FIG. 4 is a side, cross-sectional view similar to FIG. 3 showing the valve stem in the depressed, open position.

FIG. 1 shows a lock assembly of the invention for continuously dispensing the pressurized contents of an aerosol container 11. The container 11 has vertical sidewalls 12 and a convex upper end 13. The upper end has an upstanding rim 15 which concentrically surrounds an upstanding valve stem 17. The valve stem 17 is used to release the pressurized contents of the container 11 in response to shifting of the valve stem 17 relative to the container 11 between a closed position, as shown in FIG. 3, and an open position, as shown in FIG. 4.

As shown in FIG. 1, the lock assembly includes a cap 19 which has a generally cylindrical skirt portion 21 adapted for attachment to the container in a position surrounding the valve stem 17. Preferably, the cap 19 has a lower peripheral edge 23 for frictionally engaging the upstanding rims 15 of the container 11 to mount the skirt on the container in a position surrounding the stem. As shown in FIG. 2, the lower peripheral edge 23 also defines an internal shoulder 25 adapted to engage the external periphery of the rim 15.

The skirt portion 21 extends upwardly along a major circumferential portion of its lower edge 23 to provide a recess for an actuator tab 29 and also defines a gap for finger access to the actuator tab. As shown in FIG. 3, the actuator tab 29 is connected by means of a flexible hinge 31 to the skirt portion 21 within the interior recess 27. The actuator tab 29 extends across the valve stem 17 generally perpendicular thereto in the normal, closed position shown in FIG. 3. The tab 29 also includes a stem-engaging internal bore 33 and a fluid passageway 35 for connecting the stem 17 to a discharge orifice 37.

A ring lock 39 is located within the cap interior recess 27 below the actuator tab 29. The ring lock 39 has a ring-shaped body with a central opening 41 for receiving the valve stem 17. A hook portion 43 extends upwardly from the ring-shaped body .generally parallel to the valve stem 17 for engaging the actuator tab 29 when the tab 29 is depressed to move the valve stem 17 to the open position shown in FIG. 4.

Preferably, the ring-shaped body of the ring lock 39 includes a lower planar surface 45 which is received upon an upper surface 47 of the upstanding rim 15 of the container when the cap 19 is in place. The ring-shaped body also includes an upper planar surface 49. The hook portion 43 includes an upright extent 51 which extends vertically upward from the upper planar surface 49 and which terminates in a radially extending flange 53 which defines a shoulder region 55 with respect to the upright extent 51. The shoulder region 55 serves to retain the actuator tab 29 in the depressed, open position (FIG. 4) when the tab is moved beneath the shoulder 55 to open the valve stem 17.

The cap is provided with internal stop means, such as longitudinal ribs 57, located on the skirt interior wall. The stop means serve to retain the ring lock 39 firmly positioned on the upstanding rim 15 of the container when the cap 19 is in place. As shown in FIG. 2, a plurality of ribs 57 are spaced apart about the circumference of the cap interior and have lowermost extents 59 which terminate short of the lower peripheral edge 23.

As shown in FIG. 1, the lock assembly can also be provided with a remote delivery nozzle 61 for selectively controlling the release of the contents of the container. A flexible conduit 63 connects the remote delivery nozzle 61 and the discharge orifice 37 of the cap 19 for communicating the pressurized contents of the container to the remote delivery nozzle. The cap 19 can also be provided with a cover 65 having depending cylindrical sidewalls 67 sized to be received about the skirt upper portion 69 to protect the actuator tab 29.

An invention has been provided with several advantages. The lock assembly of the invention provides a simple and efficient mechanism for continuously dispensing the pressurized contents of an aerosol container. The lock assembly has few moving parts and is extremely dependable in operation. The unique ring lock is easily adapted to existing cap designs so that little or no modification is required in the tooling used to produce the cap.

While the invention has been shown in only one of its forms, it is not thus limited but is susceptible to various changes and modifications without departing from the spirit thereof.

I claim:

1. A lock assembly for continuously dispensing the pressurized contents of an aerosol container of the type having an upstanding valve stem protruding from one end of the container, the lock assembly comprising:

a cap having a generally cylindrical skirt portion adapted for attachment to the container in a position surrounding the stem, the skirt portion extending upwardly to define an interior recess;

an actuator tab hingedly connected to the cap within the interior recess and extending across the stem when the skirt is attached to the container, the actuator tab including a stem-engaging internal bore and a fluid passageway for connecting a stem so engaged to a discharge orifice;

a ring lock located within the cap interior recess below the actuator tab, the ring lock having a ring-shaped body with a central opening for receiving the valve stem and having a hook portion which extends upwardly from the ring-shaped body generally parallel to the valve stem for engaging the actuator tab when the actuator tab is depressed within the interior recess of the cap.

2. A lock assembly for continuously dispensing the pressurized contents of an aerosol container of the type having an upstanding rim concentrically surrounding an upstanding valve stem, the valve stem being used to release the pressurized contents of the container in response to shifting of the valve stem relative to the container between a closed position and an open position, the lock assembly comprising:

a cap having a generally cylindrical skirt portion with a lower peripheral edge for frictionally engaging the upstanding rim of the container to mount the skirt on the container in a position surrounding the stem, the skirt portion extending upwardly to define an interior recess;

an actuator tab hingedly connected to the cap within the interior recess and extending across the stem when the skirt is attached to the container, the actuator tab including a stem-engaging internal bore and a fluid passageway for connecting a stem so engaged to a discharge orifice;

a ring lock located within the cap interior recess below the actuator tab, the ring lock having a ring-shaped body with a central opening for receiving the valve stem and having a hook portion which extends upwardly from the ring-shaped body generally parallel to the valve stem for engaging the actuator tab when the actuator tab is depressed to move the valve stem to the open position.

3. The lock assembly of claim 2, wherein the ring-shaped body of the ring lock includes a lower planar surface which is received upon an upper surface of the upstanding rim of the container when the cap is in place.

4. The lock assembly of claim 3, wherein the ring-shaped body of the ring lock includes an upper planar surface, and wherein the hook portion includes an upright extent which extends vertically upward from the upper planar surface and which terminates in a radially extending flange which defines a shoulder region with respect to the upright extent, the shoulder region serving to retain the actuator tab in the depressed position when the tab is moved beneath the shoulder to open the valve stem.

5. The lock assembly of claim 4, wherein the cap is provided with internal stop means located within the interior of the skirt for retaining the ring lock firmly positioned on the upstanding rim of the container when the cap is in place.

6. The lock assembly of claim 5, wherein the stop means comprises a plurality of longitudinal ribs located on the skirt interior, the ribs having lowermost extents which terminate short of the lower peripheral edge of the skirt.

7. A pressurized container assembly for continuously dispensing pressurized fluids, comprising:

an aerosol container having sidewalls, a bottom and a top, the top having an upstanding rim concentrically surrounding an upstanding valve stem, the valve stem being used to release the pressurized contents of the container in response to shifting of the valve stem relative to the container between an upright, closed position and a deflected, open position;

a cap having a generally cylindrical skirt portion with a lower peripheral edge for frictionally engaging the upstanding rim of the container to mount the skirt on the container in a position surrounding the stem, the skirt portion extending upwardly along a major circumferential portion of its lower peripheral edge to provide an interior recess and a gap for finger access to the recess;

an actuator tab hingedly connected to the cap within the interior recess and extending across the stem when the skirt is attached to the container, the actuator tab including a stem-engaging internal bore and a fluid passageway for connecting a stem so engaged to a discharge orifice;

a ring lock located within the cap interior recess below the actuator tab, the ring lock having a ring-shaped body with a central opening for receiving the valve stem and having a hook portion which extends upwardly from the ring-shaped body generally parallel to the valve stem for engaging the actuator tab when the actuator tab is depressed to move the valve stem to the open position;

a remote delivery nozzle for selectively controlling the release of the contents from the container; and a flexible conduit connecting the remote delivery nozzle and the discharge orifice of the cap for communicating the pressurized contents of the container to the remote delivery nozzle.

8. The pressurized container assembly of claim 7, wherein the ring-shaped body of the ring lock includes a lower planar surface which is received upon an upper surface of the upstanding rim of the container when the cap is in place.

9. The pressurized container assembly of claim 8, wherein the ring-shaped body of the ring lock includes an upper planar surface, and wherein the hook portion includes an upright extent which extends vertically upward from the upper planar surface and which terminates in a radially extending flange which defines a shoulder region with respect to the upright extent, the shoulder region serving to retain the actuator tab in the depressed position when the tab is moved beneath the shoulder to open the valve stem.

10. The pressurized container assembly of claim 9, wherein the cap is provided with internal stop means located within the interior of the skirt for retaining the ring lock firmly positioned on the upstanding rim of the container when the cap is in place.

11. The pressurized container assembly of claim 10, wherein the stop means comprises a plurality of longitudinal ribs located on the skirt interior, the ribs having lowermost extents which terminate short of the lower peripheral edge of the skirt.

* * * * *